US005614124A

United States Patent [19]

Esche, Jr. et al.

[11] Patent Number: 5,614,124

[45] Date of Patent: Mar. 25, 1997

[54] POLYISOBUTYLENE SUCCINIMIDE, ETHYLENE-PROPYLENE SUCCINIMIDE AND AN ALKYLATED PHENOTHIAZINE ADDITIVE FOR LUBRICATING OIL COMPOSITIONS

[75] Inventors: Carl K. Esche, Jr., Wappinger Falls; Cyril A. Migdal, Croton-On-Hudson, both of N.Y.; John R. Sanderson, Leander, Tex.; Anthony L. Ippolito, Pleasant Valley, N.Y.

[73] Assignee: Ethyl Additives Corporation, Richmond, Va.

[21] Appl. No.: 481,212

[22] Filed: Jun. 7, 1995

Related U.S. Application Data

[63] Continuation of Ser. No. 384,804, Feb. 6, 1995, abandoned, which is a continuation of Ser. No. 159,611, Dec. 1, 1993, abandoned.

[51] Int. Cl.[6] ..... C10M 157/04

[52] U.S. Cl. ..... 508/251

[58] Field of Search ..... 252/47, 47.5, 51.5 A

[56] References Cited

U.S. PATENT DOCUMENTS

| | | | |
|---|---|---|---|
| 3,038,858 | 6/1962 | Verley | 252/47 |
| 3,038,859 | 6/1962 | Eickemeyer et al. | 252/47 |
| 4,089,794 | 5/1978 | Engel et al. | 252/51.5 A |
| 4,482,464 | 11/1984 | Karol et al. | 252/51.5 A |
| 4,693,838 | 9/1987 | Varma et al. | 252/51.5 A |
| 5,238,588 | 8/1993 | Nalesnik et al. | 252/51.5 A |
| 5,277,833 | 1/1994 | Song et al. | 252/51.5 A |

*Primary Examiner*—Jacqueline V. Howard
*Attorney, Agent, or Firm*—Dennis H. Rainear

[57] ABSTRACT

A lubricating oil composition comprising:

(a) a major amount of an oil of lubricating viscosity; and (b) a minor amount of a synergistic combination of an antioxidant-dispersant additive and a dispersant additive, said combination comprising:

(i) a polyisobutylene succinimide;

(ii) an ethylene-propylene succinimide; and (iii) an akylated phenothiazine represented by the formula

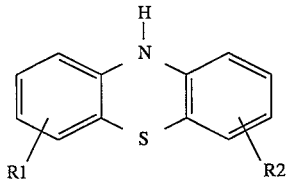

wherein $R^1$ is a linear or branched ($C_4$–$C_{24}$) alkyl, heteronlykl or alkylary group; and $R^2$ is H or a linear or branched ($C_4$–$C_{24}$) alkyl group.

7 Claims, No Drawings

POLYISOBUTYLENE SUCCINIMIDE, ETHYLENE-PROPYLENE SUCCINIMIDE AND AN ALKYLATED PHENOTHIAZINE ADDITIVE FOR LUBRICATING OIL COMPOSITIONS

This is a continuation of application Ser. No. 08/384,804 filed Feb. 6, 1995, now abandoned, which is a continuation of application Ser. No. 08/159,611 filed Dec. 1, 1993, now abandoned.

BACKGROUND OF THE INVENTION

This invention relates to lubricating oil compositions and more particularly to polyisobutylene succinimide dispersants, ethylene-propylene succinimide antioxidant-dispersants and alkylated phenothiazine antioxidants for single grade and multigrade lubricating oil compositions.

Internal combustion engines operate under a wide range of temperatures including low temperature stop-and-go service as well as high temperature conditions produced by continuous high speed driving. Stop-and-go driving, particularly during cold, damp weather conditions, leads to the formation of sludge in the crankcase and in the oil passages of a gasoline or a diesel engine. This sludge seriously limits the ability of the crankcase oil to effectively lubricate the engine. In addition, the sludge with its entrapped water tends to contribute to rust formation in the engine. These problems tend to be aggravated by the manufacturer's lubrication service recommendations which specify extended oil drain intervals.

It is known to employ nitrogen containing dispersants and/or detergents in the formulation of crankcase lubricating oil compositions. Many of the known dispersant/detergent compounds are based on the reaction of an alkenylsuccinic acid or anhydride with an amine or polyamine to produce an alkylsuccinimide or an alkenylsuccinamic acid as determined by selected conditions of reaction.

Also it is known to chlorinate alkenylsuccinic acid or anhydride prior to the reaction with an amine or polyamine in order to produce a reaction product in which a portion of the amine or polyamine is attached directly to the alkenyl radical of the alkenyl succinic acid or anhydride. The thrust of many of these processes is to produce a product having a relatively high level of nitrogen in order to provide improved dispersancy in a crankcase lubricating oil composition.

With the introduction of four cylinder internal combustion engines which must operate at relatively higher engine speeds or RPM's than conventional 6-and 8-cylinder engines in order to produce the required torque output, it has become increasingly difficult to provide a satisfactory dispersant anti-oxidant lubricating oil composition.

Recessive valve train wear, piston deposits, and oil thickening can occur at high engine operating temperatures with poorly formulated lubricating oils. Valve train wear and piston deposits can cause engine malfunction and in some cases result in engine failure. Excessive oxidative oil thickening can prevent the oil from flowing to the engine's oil pump causing the engine to seize due to lack of lubrication.

The conventional sludge dispersants for lubricating oils have been of the polyisobutenyl succinimide (PIBSAD) type for over 20 years. Recent changes in test procedures have made it more difficult to qualify these types of dispersants for use in lubricating oils without substantially increasing their treating dosage. The novel lubricating oil composition of the invention contains two different dispersants, they are low molecular weight ethylene-propylene succinimides (LEPSAD) and PIBSAD dispersants (described in numerous patents).

Together with alkylated phenothiazines (described in numerous patents) they exhibit an unexpected improvement in ASTM Sequence IIIE gasoline engine test ratings than any of these components can provide separately. This unexpected improvement in Sequence IIIE rating is a unique and useful example of synergism between different components in a lubricating oil formulation.

Thus, it is an object of the present invention to provide an effective dispersant, anti-oxidant additive for single-grade and multigrade lubricating oils.

DISCLOSURE STATEMENT

U.S. Pat. No. 4,713,189 discloses a lubricating oil composition having improved dispersancy and viton seal compatibility. The dispersant being prepared by coupling two polyethyleneamines with an aldehyde and a phenol, followed by conversion to a succinimide. The resulting coupled succinimide is then acylated with glycolic acid to form a glycolated Mannich phenol coupled mono-alkenyl succinimide.

U.S. Pat. No. 4,699,724 discloses a lubricating oil composition having improved dispersancy and Viton seal compatibility. The dispersant being prepared by coupling two mono-alkenyl succinimides with an aldehyde and phenol. The resulting coupled succinimide is then acylated with glycolic acid to form a glycolated Mannich phenol coupled mono-alkenyl succinimide.

U.S. Pat. No. 4,636,322 discloses a lubricating oil composition having improved dispersancy and Viton seal compatibility. The dispersant being prepared by coupling partly glycolated succinimides with an aldehyde and a phenol.

U.S. Pat. No. 4,089,794 discloses ethylene copolymers derived from about 2 to 98 wt. % ethylene, and one or more $C_3$ to $C_{12}$ alpha olefins, e.g. ethylene-propylene, are solution-grafted under an inert atmosphere and at elevated temperatures with an ethylenically-unsaturated carboxylic acid material in the presence of a high-temperature decomposable free-radical initiator and thereafter reacted with a polyfunctional material reactive with carboxyl groups, such as (a) a polyamine, or (b) a polyol, or (c) a hydroxylamine, or mixtures thereof, to form carboxyl-grafted polymeric derivatives, which have good engine sludge and varnish control behavior in fuels and lubricating oils. If the molecular weight is above 10,000 then these polymers are also useful as multifunctional viscosity index improvers.

U.S. Pat. Nos. 4,137,185 and 4,144,181 disclose an oil-soluble, derivatized ethylene copolymers derived from about 2 to 98 wt. % ethylene, and one or more $C_3$–$C_{28}$ alphaolefins, e.g. propylene, which are grafted, preferably solution-grafted under an inert atmosphere and at elevated temperatures and in the presence of a high-temperature, decomposable free-radical initiator, with an ethylenically-unsaturated dicarboxylic acid material and thereafter reacted with a polyamine having at least two primary amine groups, e.g. an alkylene polyamine such as diethylene triamine, to form carboxyl-grafted polymeric imide, usually maleimide, derivatives are reacted with an anhydride of a ($C_1$–$C_{30}$) hydrocarbyl substituted acid, preferably acetic anhydride, to yield an oil-soluble stable amide of said polyamine whereby oil solutions of said amide derivative are characterized by minimal viscosity change over an extended period of time.

Useful number average molecular weight ($M_n$) of said copolymers range from about 700 to 500,000; however, if the molecular weight is from 10,000 to 500,000 then these copolymers are also useful as multifunctional viscosity index improvers.

U.S. Pat. No. 4,146,489 discloses graft copolymers wherein the backbone polymer is a rubbery, oil soluble ethylene-propylene copolymer or ethylene-propylene diene modified terpolymer and the graft monomer is a C-vinylpyridine or N-vinylpyrrolidone impart dispersant properties to hydrocarbon fuels and combined viscosity index improvement and dispersant properties to lubricating oils for internal combustion engines. The graft copolymers are prepared by intimate admixture of backbone polymer, graft monomer and free radical initiator at a temperature below initiation temperature, followed by a temperature increase to or above initiation temperature, thus providing a product containing little or no byproduct.

U.S. Pat. No. 4,320,019 discloses reaction products prepared by reacting (a) interpolymers of ethylene, one or more $C_3$–$C_8$ amonoolefins, and one or more polyene selected from non-conjugated dienes and trienes, with (b) one or more olefinic carboxylic acid acylating agents to form an acylating reaction intermediate which is further reacted with (c) an amine.

These reaction products have been found useful as multifunctional additives to a variety of lubricating oils for enhancing their dispersancy as well as improving their viscosity-temperature relationship.

U.S. Pat. No. 4,340,689 discloses a process for grafting functional organic groups onto EPM and EPDM polymers wherein the grafting reaction is carried out in the cement in which the polymer is originally formed by solution polymerization.

U.S. Pat. No. 4,357,250 discloses compositions useful as dispersant and viscosity modifiers in lubricants are produced by (1) preparing an ene reaction intermediate from an olefinic carboxylic acid or derivative thereof (preferably maleic anhydride) and a terpolymer of ethylene, a $C_3$–$C_8$ alpha monoolefin and a non-conjugated diene or triene, and (II) reacting said ene reaction intermediate with monoamine-polyamine mixture.

U.S. Pat. No. 4,382,007 discloses a dispersant VI improvers prepared by reacting a polyamine-derived dispersant with an oxidized ethylene-propylene polymer or ethylene-propylene-diene terpolymer. The products thus formed have a dispersancy superior to that obtained by separately blending the reactants in a lubricating oil. Also, disclosed are oils containing the present dispersant VI improvers.

U.S. Pat. No. 4,863,623 discloses an additive composition comprising a graft and amine-derivatized copolymer prepared from ethylene and at least one $C_3$–$C_{10}$ alpha-monoolefin and, optionally, a polyene selected from non-c-non-conjugated dienes and trienes comprising from about 15 to 80 mole percent of ethylene, from about 20 to 85 mole percent of said $C_3$–$C_{10}$ alpha monoolefin and from about 0 to 15 mole percent of said polyene having a average molecular weight ranging from about 5000 to 500,000 which has been reacted with at least one olefinic carboxylic acid acylating agent to form one or more acylating reaction intermediates characterized by having a carboxylic acid acylating function within their structure and reacting said reaction inter- mediate with an aminoaromatic polyamine compound from the group consisting of an N-arylphenylenediamine, an aminothiazole, an aminocarbazole, an amionindole, an aminopyrrole, an amino indazolinone, an aninomercap- totriazole, and an aminoperimidine to form said graft and amine-derivatized copolymer, and a lubricating oil composition containing same are provided.

U.S. Pat. No. 5,102,570 discloses a lubricating oil composition having improved dispersancy and antioxidancy. The dispersant being prepared by coupling mono- and/or bisalkenyl succinimides with an aldehyde and hydroxyaromatic amine. The resulting coupled succinimide is then acylated with an acylating agent to form a Mannich hydroxyaromatic amone coupled acylated mono and/or bisalkenyl succcinimide.

U.S. Pat. No. 5,075,383 discloses an additive composition comprising a graft and amine-derivatized copolymer prepared from ethylene and at least one $C_3$–$C_{10}$ alpha-monoolefin and, optionally a polyene selected from non-conjugated dienes and trienes comprising from about 15 to 80 mole percent of ethylene, from about 20 to 85 mole percent of said $C_3$ to $C_{10}$ alpha-monoolefin and from about 0 to 15 mole percent of said polyene, said copolymer having a number average molecular weight ranging from about 5,500 to 50,000 and having grafted thereon at least 1.8 molecules of a carboxylic acid acylating function per molecule or said copolymer and reacting said grafted copolymer with an amino-aromatic polyamine compound from the group consisting of an N-arylphenylenediamine, an aminocarbazole, and an amino-pyrimidine to form said graft and amine-derivatized copolymer, and a lubricating oil composition containing same are provided.

The disclosures of U.S. Pat. No. 4,482,464; U.S. Pat. No. 4,713,489 and U.S. Pat. No. 5,075,383 in their entirety are incorporated herein by reference.

SUMMARY OF THE INVENTION

This invention provides a lubricating oil composition comprising:

(a) a major amount of an oil of lubricating viscosity; and (b) a minor amount of a combination of an antioxidant-dispersant additive, a dispersant additive and an antioxidant additive, said combination comprising:

(i) a polyisobutylene succinimide (PIBSAD);

(ii) an ethylene-propylene succinimide (LEPSAD); and (iii) an alkylated phenothiazine represented by the formula

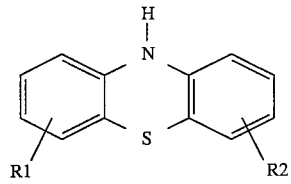

wherein $R^1$ is a linear or branched ($C_4$–$C_{24}$) alkyl, heteroalkyl or alkyl aryl group; and $R^2$ is H or a linear or branched ($C_4$–$C_{24}$) alkyl group.

DETAILED DESCRIPTION OF THE INVENTION

There is no known prior art combining a PIBSAD and LEPSAD dispersants, and an alkylated phenothiazine in a lubricating oil formulation to make an oil with such excellent antioxidant properties. Data was also generated which demonstrates that alkylated phenothiazine performs better than alkylated diphenylamine as an antioxidant in the Sequence IIIE test when in a composition with PIBSAD and LEPSAD.

The LEPSAD dispersant of this invention comprises an ethylene copolymer or terpolymer of a $C_3$ to $C_{10}$ alpha-monoolefin and optionally a non-conjugated diene or triene having a number average molecular weight (Mn) ranging from about 5,500 to 50,000 (6,000 to 10,000 preferred) on which, at some stage of one of the processes, has been grafted at least 1.8 molecules per copolymer molecule of an ethylenically unsaturated carboxylic function which is then further derivatized with an amino-aromatic polyamine compound such as N-arylphenylenediamine represented by the formula

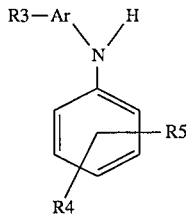

in which $R^3$ is H, —NHaryl, —NHarylalkyl, a branched or straight chain radical having 4 to 24 carbon atoms that can be alkyl, alkenyl, alkoxyl, aralkyl, alkaryl, hydroxyalkyl or aminoalkyl, $R^4$ is $NH_2$, $CH_2$—$(CH_2)$n—$NH_2$, —$CH_2$—aryl—$NH_2$ in which n has a value from 1 to 10, $R^5$ is alkyl, alkenyl, alkoxyl, aralkyl, alkaryl, having from 4 to 24 carbons.

The ethylenically unsaturated carboxylic function can be a dicarboxylic acid, anhydride or ester thereof, such as fumaric acid, itaconic acid, maleic acid, maleic anhydride, chloromaleic acid, dimethylfumarte, chloromaleic anhydride, and mixtures thereof.

The above antioxidant moiety can be mixed in all proportions with other polyamines on the polymer backbone and produce a useful product. The polyamines which can be used in mixtures with N-arylphenylenediamine contain only one primary amine, no secondary amines unless highly hindered, and all the rest are tertiary amines. Examples of such amines are:

aminopropylmorpholine aminoethylmorpholine

N',N'-dimethylaminoproplyamine

N', N'-dimethyletylamine

N-methylaminopropylpiperzine

The composition of matter described in U.S. Pat. No. 5,075,383 can be manufactured via a solution polymerization technique. The additive can be manufactured by the above process or preferably via mechanical/thermal shearing techniques. The mechanical/thermal shearing can be done in either an extruder or a batch intensive mixer (Haake or Brabender) or a simple reaction vessel. The mechanical/thermal shearing brings about degradation of the high molecular weight polymer (i.e. 100,000 Mn) to a low molecular weight polymer (ie. 10,000 Mn) which has now lost its VI improving properties and becomes a shear stable intermediate from which an antioxidant/dispersant can be manufactured. The shearing may be done to the starting ethylene-propylene copolymer rubber and then grafted with an ethylenically unsaturated carboxylic function (i.e. maleic anhydride) and then further derivatized with an amino-aromatic polyamine (i.e. N-arylphenylenediamine).

Alternatively, shearing may be done to the prederivatized rubber followed by treatment with an amino-aromatic polyamine. In the case where an extruder is used the ethylene-propylene copolymer rubber may be grafted with an ethylenically unsaturated carboxylic function while simultaneously being sheared.

The PIBSAD dispersant of this invention comprises reagents that are step wise reacted with a long chain hydrocarbyl substituted dicarboxylic acid anhydride containing residual unsaturation in a "one pot reaction". The long chain hydrocarbon group is a ($C_2$–$C_{10}$) polymer, e.g., a ($C_2$–$C_5$) monoolefin, the polymer having a number average molecular weight (Mn) of about 500 to about 10,000.

Preferred olefin polymers for reaction with the unsaturated dicarboxylic acid anhydride or ester are polymers comprising a major molar amount of ($C_2$–$C_{10}$) polymer, e.g., a ($C_2$–$c_5$) monoolefin. Such olefins include ethylene, propylene, butylene, isobutylene, pentene, 1-octene, styrene, etc. The polymers can be homopolymers such as polyisobutylene, as well as copolymers of two or more of such olefins such as copolymers of: ethylene and propylene, butylene and isobutylene, propylene and isobutylene, etc. Other copolymers include those in which a minor molar amount of the copolymer monomers e.g., 1 to 10 mole % is a ($C_4$–$C_{10}$) non-conjugated diolefin, e.g., a copolymer of isobutylene and butadiene; or a copolymer of ethylene, propylene and 1,4-hexadiene; etc.

In some cases, the olefin polymer may be completely saturated, for example an ethylene-propylene copolymer made by a Ziegler-Natta synthesis using hydrogen as a moderator to control molecular weight. In this case the alpha- or beta- unsaturated dicarboxylic acid anhydride is reacted with the saturated ethylene-propylene copolymer utilizing a radical initiator.

The long chain hydrocarbyl substituted dicarboxylic acid producing material, e.g. acid or anhydride used in the invention includes a long chain hydrocarbon, generally a polyolefin, substituted typically with an average of at least about 0.8 per mole of polyolefin, of an alpha- or beta-unsaturated ($C_4$–$C_{10}$) dicarboxylic acid, anhydride or ester thereof, such as fumaric acid, itaconic acid, maleic acid, maleic anhydride, chloromaleic acid, dimethylfumarte, chloromaleic anhydride, acrylic acid methacrylic acid, crotonic acid, cinnamic acid, and mixtures thereof.

The alkenyl succinic acid anhydride may be characterized by the following formula

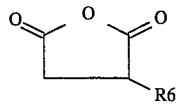

In the above formula, $R^6$ may be a residue (containing residual unsaturation) from a polyolefin which was reacted with maleic acid anhydride to for the alkenyl succinic acid anhydride. $R^6$ may have a number average molecular weight (Mn) ranging from about 500–10,000, preferably about 1000–5000, and more preferably from about 2000–2500.

The aldehyde which may be employed may include those preferably which characterized by the formula $R^7CHO$. In the preceding compound, $R^7$ may be hydrogen or a hydrocarbon group consisting of alkyl, aralkyl, cycloalkyl, aryl, alkyaryl, alkenyl, and alkynyl including such radicals when inertly substituted. When $R^7$ is alkyl, it may typically be methyl, ethyl, n-propyl, isopropyl, n-butyl, isobutyl, secbutyl, amyl, octyl, decyl, dodecyl, octadecyl, etc. When $R^7$ is aralkyl, it may typically be benzyl, beta-phenylethyl, etc. When $R^7$ is cycloalkyl, it may typically be cyclohexyl, cycloheptyl, cyclooctyl, 2-methylcycloheptyl, 3-butyl-butylcyclohexyl, 3-methylcyclohexyl, etc. When $R^7$ is alkaryl, it may typically be tolyl, xylyl, etc. When $R^7$ is alkylnyl, it may typically be ethynyl, propynyl, butynyl, etc. When $R^7$ is aryl, it may typically be phenyl, naphthyl, etc. When $R^7$ is alkenyl, it may typically be vinyl, allyl, 1-butenyl, etc. $R^7$ may be inertly substituted i.e. it may bear a non-reactive substituent such as alkyl, aryl, cycloalkyl, ether, halogen, nitro, etc. Typically inertly substituted R groups may include 3-chloropropyl, 2-ethoxyethyl, carboethoxymethyl, 4-methyl cyclohexyl, p-chlorophenyl, p-chlorobenzyl, 3-chloro-5-methylphenyl, etc. The preferred $R^7$ groups may be lower alkyl, i.e. $C_1$–$C_{10}$ alkyl, groups including methyl, ethyl, n-propyl, isopropyl, butyls, amyls, hexyls, octyls, decyls, etc. $R^7$ may preferably be hydrogen.

Typical aldehydes which may be employed may include those listed below:

formaldehyde ethanal propanal butanal etc.

The hydroxyaromaticamine compound is represented by the formulas

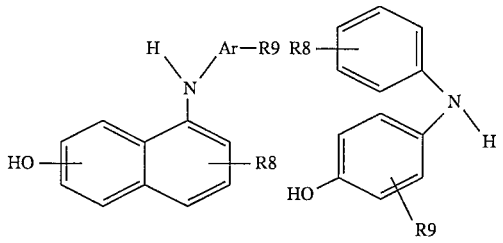

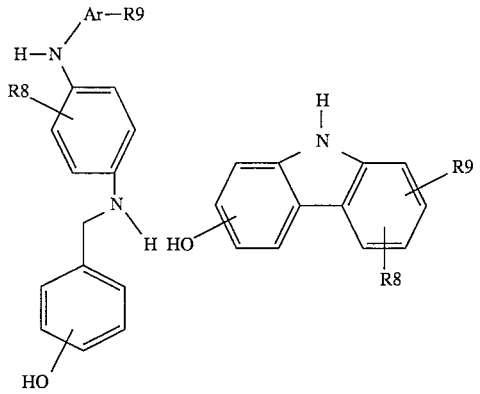

in which $R^8$ is H, alkyl, alkenyl, alkoxyl, aralkyl, alkaryl, —NHaryl, —NHarylalkyl, a branched or straight chain radical having 4 to 24 carbon atoms that can be alkyl, alkenyl, alkoxyl, aralkyl, alkaryl, hydroxyalkyl or aminoalkyl, $R^9$ is $NH_2$, $CH_2$—$(CH_2)n$—$NH_2$, —$CH_2$—aryl—$NH_2$ in which n has a value from 1 to 10.

It is a feature of these hydroxyaromaticamines that they contain an active hydrogen which will be a site for substitution. Poly-phenols (e.g. compounds containing more than one hydroxy group in the molecule whether on the same ring or not) may be employed. The rings on which the hydroxy groups are situated may bear substituents. However, at least one positions e.g. ortho- and para-, to a hydroxy group, must be occupied by an active hydrogen as this is the point of reaction with the minimum salt group. The preferred hydroxy-aromaticamine is 4-hydroxydiphenylamine.

The polyamine compositions which may be employed in practicing the present invention may include primary and/or secondary amines. The amines may typically be characterized by the formula

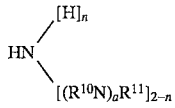

In this formula, a may be an integer of about 3 to about 8, preferably about 5; and may be 0 or 1. In the above compound, $R^{10}$ may be hydrogen or a hydrocarbon group selected from the group consisting of alkyl, aralkyl, cycloalkyl, aryl, alkaryl, alkenyl, and alkynyl, including such radicals when inertly substituted. The preferred $R^{11}$ groups may be hydrogen or lower alkyl group, i.e. $C_1$–$C_{10}$ alkyl, groups including e.g. methyl, ethyl, n-propyl, i-propyl, butyls, amyls, hexyls, octyls, decyls, etc. $R^{11}$ may preferably be hydrogen. $R^{10}$ may be a hydrocarbon selected from the same group as $R^{11}$ subject to the fact that $R^{10}$ is divalent and contains one less hydrogen. Preferably $R^{11}$ is hydrogen and $R^{10}$ is —$CH_2CH_2$—. Typical amines which may be employed may include those listed below:

diethylenetriamine (DETA)

triethylenetetramine (TETA)

tetraethylenepentamine (TEPA)

pentaethylenehexamine (PEHA)

The secondary amine groups of the polyalkenylamine moiety in said coupled mono- and/or bis-alkenyl succinimide are reacted with either a acylating and/or borating agent. The borating agent is selected from the group consisting of boric acid, boron oxide, boron halide, and a boron acid ester, to provide a borated derivative thereof. The acylating agent is selected from the group consisting of hydroxyaliphatic acid that contains from 1 to 4 carbon atoms exclusive of the carbonyl group. The preferred hydroxy-aliphatic acid is glycolic acid.

An alkylated phenothiazine suitable for this invention must be oil soluble and correspond to the general formula:

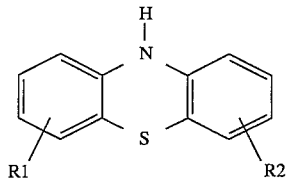

The alkylated phenothiazine maybe mono or disubstituted and $R^1$ and $R^2$ can be the same or different alkyl, heteroalkyl, or alkylaryl groups. Typically $R^1$ is a linear or branched alkyl group from 4 to 24 carbons and $R^2$ is an hydrogen atom or a linear or branched alkylgroup from 4 to 24 carbons. Typical examples of such alkylated phenothiazines are tetradecylphenothiazine and decylphenothiazine.

The lubricating oil composition of the invention will contain the novel reaction products in concentrations ranging from about 0.01 to 30 weight percent. A concentration range for the PIBSAD and LEPSAD dispersant additives ranging from about 0.5 to 15 weight percent based on the total weight of the oil composition is preferred with a still more preferred concentration range being from about 1 to 8.0 weight percent. A concentration range for the alkylated phenothiazine antioxidant additives ranging from about 0.1 to 1 weight percent based on the total weight of the oil composition is preferred with a still more preferred concentration range being from about 0.15 to 0.6 weight percent. Oil con- centrates of the additives may contain from about 1 to 100 weight percent of the additive reaction product in a carrier or diluent oil of lubricating oil viscosity.

The novel reaction product of the invention may be employed in lubricant compositions together with conventional lubricant additives. Such additives may include additional dispersants, detergents, antioxidants, pour point depressants, anti-wear agents, viscosity index improvers, anti-foam agents and the like.

The novel lubricating oil composition of the invention was tested for its effectiveness in a ASTM Sequence IIIE gasoline engine test.

The advantages of the above described process and the present lubricating oil compositions will be more apparent by the Examples provided below.

EXAMPLE A

Preparation of Dispersant-Antioxidant From Ethylene-Propylene Copolymer Solution Grafted With About 3.8 Molecules Maleic Anhydride Per Copolymer Molecule A 62.5 weight percent mixture of ethylene-propylene copolymer grafted with 2.5 weight percent maleic anhydride in oil (1431.5 g) was charged into a 3000 mL 4-neck kettle along with 100 P Pale oil (982.4 g). The kettle was equipped with a mechanical stirrer, thermometer, thermocouple, and nitrogen inlet and heated to 160° C. Next N-phenyl-p-phenylenediamine (45.9 g, 0.249 moles) was added along with Surfonic N-40 (71.5 g). The reaction temperature was maintained at 160° C. for 6 hours. The product (an approximately 37% concentrate) analyzed as follows: % N=0.41 (0.28 calc.), Kinematic Viscosity (100 C)=3590 cSt.

EXAMPLE B

The Mechanical/Thermal Shearing Preparation of Dispersant-Antioxidant From Ethylene-Propylene Copolymer The ethylene-propylene copolymer (about 100,000 Mn) was chopped and processed through an extruder in a molten state at a temperature near 400° C., just prior to entering the extruder screw maleic anhydride and dicumyl peroxide were mixed with the molten polymer and the polymer exiting from the die face of the extruder was mixed with SNO 100 oil. Analysis by titration of rubber isolated from the oil found it to be grafted with 2.1% maleic anhydride. The ethylene-propylene copolymer grafted with 2.1 weight percent maleic anhydride (1543.1 g) was dissolved in SNO 100 oil (468.9 g) in a 3000 mL 4-neck kettle at 160° C. The kettle was equipped with a mechanical stirrer, thermometer, thermocouple, and nitrogen inlet. Next N-phenyl-p-phenylenediamine (29.3 g, 0.159 moles) was added along with Surfonic L46–7 (60 g). The reaction temperature was maintained at 160° C. for 6 hours. The product (an approximately 37% concentrate) analyzed as follows: % N=0.22 (0.21 calc.), Kinematic Viscosity (100° C.)=913.8 cSt.

EXAMPLE C

The Synthesis of Dispersant-Antioxidant from Ethylene-Propylene Copolymer Solution Grafted with 3.8 Molecules of Maleic Anhydride Per Copolymer Molecule Using a Mixture of Amines A 62.5 weight percent mixture of ethylene-propylene copolymer grafted with 2.5 weight percent maleic anhydride in oil (1200 g) was charged into a 4000 mL 4-neck kettle along with 100 P Pale oil (1200 g). The kettle was equipped with a mechanical stirrer, thermometer, thermocouple, and nitrogen inlet and heated to 160° C. Next N-phenyl-p-phenylenediamine (17.3 g, 0.094 moles) and N,N-dimethylaminopropylamine (9.6 g, 0.094 moles) was added along with Surfonic N-40 (60 g). The reaction temperature was maintained at 160° C. for 6 hours. The product (an approximately 31% concentrate) analyzed as follows: % N=0.31 (0.42 calc.) and Kinematic Viscosity (100° C.)

EXAMPLE D

Preparation of acylated Mannich hydroxyaromaticamine coupled mono- and/or bisalkenyl succinimide dispersant A solution of polyisobutenylsuccinic acid anhydride (3965.0 g, 1.0 moles, PIBSA prepared from an approximately 2060 mol. wt. polybutene) in diluent oil (2347.3 g) was charged into a twelve liter 3-neck flask equipped with a mechanical stirrer, thermometer, thermocouple, and nitrogen inlet and heated to 60° C. Next pentaethylenehexamine (145.2 g, 0.55 moles) was added and the heat was increased to 120° C. and maintained for 2.0 hours. Then 4-hydroxydiphenylamine (50.0 g, 0.27 moles) was added, followed by a 37% solution of formaldehyde (87.6 g, 1.08 moles). The temperature was maintained at 120° C. for 0.5 hours. Next a 70% solution of glycolic acid (159.8 g, 1.48 moles) was added and the temperature was raised to 160° C. and then maintained for 4 hours to drive off water. The hot mixture (~100° C.) was filtered through diatomaceous earth filter aid. The product (an approximately 50% concentrate) analyzed as follows: % N=0.70 (0.82 calc.) and Total Acid Number (TAN)=2.4.

EXAMPLE E

Preparation of Acylated Mannich Hydroxyaromatic Amine Coupled Mono- and/or Bis-Alkenyl Succinimide Dispersant A solution of polyisobutenylsuccinic acid anhydride (2799.0 g, 1.5 moles, PIBSA prepared from an approximately 1290 mol. wt. polybutene) in diluent oil (3225.0 g) was charged into a twelve liter 3-neck flask equipped with a mechanical stirrer, thermometer, thermocouple, and nitrogen inlet and heated to 60° C. Next pentaethylenehexamine (217.8 g, 0.825 moles) was added and the heat was increased to 120° C. and maintained for 2.0 hours. Then 4-hydroxydiphenylamine (74.9 g, 0.405 moles) was added, followed by a 37% solution of formaldehyde (131.4 g, 1.62 moles). The temperature was maintained at 120° C. for 0.5 hours. Next a 70% solution of glycolic acid (239.8 g, 2.22 moles) was added and the temperature was raised to 160° C. and then maintained for 4 hours to drive off water. The hot mixture (~100° C.) was filtered through diatomaceous earth filter aid. The product (an approximately 40% active concentrate) analyzed as follows: % N=1.39 (1.25 calc.) and Total Base Number (TBN)=16.6.

EXAMPLE F

Preparation of Tetradecylalkyldiphenylamine

Diphenylamine (350 G ), 1-tetradecene (1000 G), and dry Engelhard Clay-13 ( 135 G ) were charged to a three liter flask equipped with overhead stirrer, water cooled condenser, heating mantle, and nitrogen purge. The mixture was vigorously stirred and heated to 120° C. for 2 hours, 140° C. for 2 hours, and 160° C. for 2 hours. The mixture was then cooled to ambient temperature, and the catalyst removed by suction filtration. A clear to amber colored liquid was obtained (1254 G ). The liquid was vacuum distilled using a small vigreux column to a pot temperature of 250° C. and a head temperature of 202° C. at 0.4 to 0.9 mm Hg. The overhead was 564 G and consisted of mostly unreacted olefin with small amounts of diphenylamine. The bottoms product (689 G ) was pale yellow and consisted of a mixture of alkyldiphenylamine by IR analysis. By micro Kjeldahl, the product contained 2.43% nitrogen.

EXAMPLE G

Preparation of decyldiphenylamine

Diphenylamine (338 G ) , 1-decene (2000 G ) and dry Engelhard Clay—13 (250 G ) were charged to a 5 liter flask equipped with overhead stirrer, water cooled condenser, heating mantle, and nitrogen purge. The mixture was vigorously stirred and heated to 120° C. for 4.0 hours, 140° C. for 2.0 hours, and 160° C for 1.0 Hours. The mixture was then cooled to ambient temperature, and the catalyst removed by suction filtration. A clear to amber colored liquid was obtained (2176 G ). The liquid was vacuum distilled using a small vigreux column. Fractions were taken as shown below:

| No. | Wt (Gms) | Pot (Deg C.) | Head (C.) | P (mm HG) |
|---|---|---|---|---|
| 1. | 1361.9 | 33–212 | 25–50 | 4–0.3 |
| 2. | 36.3 | 226–253 | 85–165 | 0.3 |
| 3. | 150.4 | 248–167 | 175–190 | 0.3 |
| 4. | 296.6 | 292 | 203 | 0.3 |
| 5. | 381.5 | 285–329 | 190–240 | 0.3 |
| 6. | 78.1 | 334–342 | 250–360 | 0.3–0.5 |
| Pot | 80.4 | | | |

Fractions 3 to 5 were combined and used in example I.

EXAMPLE H

Preparation of C14 alkylphenothiazine

Into a round bottom flask equipped with a stirrer, reflux condenser, thermometer, thermocouple, and nitrogen gas inlet tube are added the following: C14 alkyldiphenylamine as prepared in Example F (139.5 gms, 0.384 moles, ), elemental sulfur (36.8 gms, 1.152 moles), iodine (9.90 grams, 0.039 moles) and xylene (255 ml). Nitrogen gas was bubbled into the reaction mixture at 200 ml/min and with vigorous stirring the reaction mixture was cooked at 140° C. for six hours. The reaction mixture was cooled to room temperature and then suction filtered through filter aid. The product was then stripped of iodine and solvent on a rotovap under vacuum at 140° C. for one hour to yield 134 grams of product. Found analytical analysis: % S =10.0, % N=2.75.

EXAMPLE I

Preparation of C10 Alkylphenothiazine

Into a round bottom flask equipped with a stirrer, reflux apparatus, thermometer, thermocouple, and gas inlet tube are added the following: C10 alkyldiphenylamine as prepared in Example G (122.0 gms, 0.300 moles ), elemental sulfur (29.0 gms, 0.900 moles), iodine (7.62 gms, 0.030 moles) and mixed xylene (200 ml). Nitrogen gas was bubbled through the reaction mixture at 200 ml/min and with vigorous stirring, the reaction was cooked at 140° C. for six hours. The reaction mixture was cooled to room temperature, and then suction filtered through filter aid. The product was then stripped of solvent and iodine on a rotovap under vacuum at 140° C. for one hour to yield 115 gms of product. Found analytical data: % S=9.56, % N=2.85.

EXAMPLE J

ASTM Sequence IIIE Gasoline Engine Test

The ASTM Sequence IIIE test is used to evaluate an engines oil's ability to a) withstand oxidative oil thickening and b) protect engine parts against high temperature wear and deposits.

This test uses a 1987 Buick 3.8L V-6 engine equipped with jacketed rocker covers and a jacketed crankcase breather tube. The engine is also equipped with a special test camshaft and lifters to aid in wear discrimination between oils of various performance levels.

The test begins with a four hour "break-in". After "break-in", the engine is run for 64 hours at high speed, heavy load and high temperature to simulate a full-size car pulling a trailer at highway speeds.

Sequence IIIE gasoline engine test results are in Table I for three oils. Oil A contained PIBSAD and LEPSAD dispersants and no antioxidant. Oil B contained PIBSAD and LEPSAD dispersants and alkylated diphenylamine. Oil C contained PIBSAD and LEPSAD dispersants and alkylated phenothiazine. The concentrations of PIBSAD and LEPSAD and all other additives in the oil formulation were held constant in all three formulas, with the exception that oil A had no antioxidant. Oil's B and C contained the same level of antioxidant. Only oil C passed the API SG limits for a Sequence IIE engine test. Both oils A and B failed wear, oxidative oil thickening, and piston deposit criteria.

TABLE I

SEQUENCE IIIE GASOLINE ENGINE TEST RESULTS

| RATINGS | OIL A | OIL B | OIL C | API | SG LIMITS |
|---|---|---|---|---|---|
| VISCOSITY INCREASE, %, 64 HR. | 827 | 483 | 196 | 375 | MAX. |
| AVERAGE ENGINE SLUDGE | 9.37 | 9.42 | 9.53 | 9.2 | MIN. |
| AVERAGE PISTON SKIRT VARNISH | 8.52 | 8.52 | 9.11 | 8.9 | MIN. |
| OIL RING LAND DEPOSITS | 3.16 | 3.32 | 3.81 | 3.5 | MIN. |

TABLE I-continued

| SEQUENCE IIIE GASOLINE ENGINE TEST RESULTS | | | | | |
|---|---|---|---|---|---|
| RATINGS | OIL A | OIL B | OIL C | API | SG LIMITS |
| AVERAGE CAM LOBE WEAR | 59.2 | 104.3 | 4.5 | 30.0 | MAX. |
| MAXIMUM CAM LOBE WEAR | 201 | 252 | 9 | 64.0 | MAX. |
| STUCK RINGS | 3 | NONE | NONE | NONE | |

We claim:

1. A lubricating oil composition consisting essentially of:

(a) a major amount of an oil of lubricating viscosity; and (b a minor amount of a combination of an antioxidant-dispersant additive, a dispersant additive and an anti-oxidant additive, said combination comprising:

(i) a polyisobutylene succinimide;

(ii) an ethylene-propylene succinimide; and (iii) an alkylated phenothiazine represented by the formula

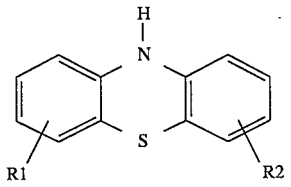

wherein $R^1$ is a linear or branched ($C_4$–$C_{24}$) alkyl, group; and $R^2$ is H or a linear or branched ($C_4$–$C_{24}$) alkyl group.

2. The lubricating oil composition of claim 1, wherein the concentration of additives ranges from about 0.01 to about 30 wt. % based on the total weight of said oil composition.

3. The lubricating oil composition of claim 1, wherein the concentration of said alkylated phenothiazine ranges from about 0.1 to about 1.0 wt. % based on the total weight of said oil composition.

4. The lubricating oil composition of claim 1, wherein the concentration of said dispersant additives ranges from about 0.5 to about 15.0 wt. % based on the total weight of said oil composition.

5. The lubricating oil composition of claim 1, wherein said alkylated phenothiazine is tetradecylphenothiazine or decylphenothiazine.

6. The lubricating oil composition of claim 1, wherein said alkylated phenothiazine is tetradecylphenothiazine.

7. The lubricating oil composition of claim 1 wherein $R^1$ is a linear or branched ($C_4$–$C_{24}$) alkyl and $R^2$ is H.

* * * * *